US008978605B2

(12) United States Patent
Friedrichs

(10) Patent No.: US 8,978,605 B2
(45) Date of Patent: Mar. 17, 2015

(54) PHASE-ADJUSTING DEVICE OF A CAMSHAFT FOR AN INTERNAL COMBUSTION ENGINE

(75) Inventor: Matthias Friedrichs, Bremen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/126,182

(22) PCT Filed: Feb. 27, 2012

(86) PCT No.: PCT/EP2012/053277

§ 371 (c)(1),
(2), (4) Date: Feb. 12, 2014

(87) PCT Pub. No.: WO2012/171672

PCT Pub. Date: Dec. 20, 2012

(65) Prior Publication Data

US 2014/0174386 A1 Jun. 26, 2014

(30) Foreign Application Priority Data

Jun. 15, 2011 (DE) ..... 10 2011 077 532

(51) Int. Cl.
*F01L 1/34* (2006.01)
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01)
USPC ..... 123/90.16; 123/90.15; 123/90.17; 123/90.6; 29/888.1

(58) Field of Classification Search
USPC ..... 123/90.15, 90.16, 90.17, 90.6; 29/888.1
See application file for complete search history.

(56) References Cited

U.S. PATENT DOCUMENTS

| | | | | |
|---|---|---|---|---|
| 5,020,487 | A | 6/1991 | Krueger | |
| 7,610,890 | B2 * | 11/2009 | Lettmann et al. | 123/90.6 |
| 2008/0257290 | A1 | 10/2008 | Lettmann et al. | |

FOREIGN PATENT DOCUMENTS

| | | |
|---|---|---|
| DE | 27 47 884 | 5/1979 |
| DE | 42 26 798 | 2/1994 |
| DE | 10 2005 014 680 | 8/2006 |
| DE | 10 2007 017514 | 10/2008 |
| WO | WO 2008/125565 | 10/2008 |

* cited by examiner

*Primary Examiner* — Ching Chang
(74) *Attorney, Agent, or Firm* — Davidson, Davidson & Kappel, LLC

(57) ABSTRACT

A camshaft adjusting device of an internal combustion engine having two camshafts supported concentrically to one another, the axial position of the outer camshaft being determined by an axial bearing and the outer camshaft interacting with a sealing cover of an adjusting apparatus. A first cam is rotationally fixed to the outer camshaft. A second cam is rotationally fixed to the inner camshaft, which can be rotated relative to the outer camshaft by the adjusting apparatus, wherein the inner camshaft has a locking contour on at least one section of the outside of the inner camshaft, which locking contour engages in a form-closed manner in a mating contour on at least one section of the inside of the outer camshaft in order to fix the axial position of the inner camshaft relative to the outer camshaft.

11 Claims, 4 Drawing Sheets

PHASE-ADJUSTING DEVICE OF A CAMSHAFT FOR AN INTERNAL COMBUSTION ENGINE

The present invention relates to a camshaft adjusting device of an internal combustion engine, including two camshafts which are supported concentrically to each other, the axial position of the outer camshaft being determined by an axial bearing and having an active relationship with a sealing cover of an adjusting device, a first cam being rotatably fixedly mounted on the outer camshaft, and a second cam being rotatably fixedly connected to the inner camshaft, the inner camshaft furthermore being able to rotate relative to the outer camshaft with the aid of the adjusting device.

BACKGROUND

Camshaft adjusting devices are used for particularly accurate and fine control of the combustion in an internal combustion engine.

For this reason, one or multiple inlet valves is/are adjusted relative to a driving element, such as a crank wheel, which is driven via the crankshaft with the aid of a traction means drive. However, the outlet cams may also be adjusted.

The use of two camshafts is known from the prior art, for example DE 4226798 A1, the outer camshaft completely encompassing the inner camshaft, at least in sections. The inner camshaft is supported within the outer camshaft.

DE 4226798 A1 discloses a reciprocating internal combustion engine which has two gas exchange valves per cylinder. Two inlet valves of an internal combustion engine cylinder system are actuated by two cams which are adjustable in relation to each other with regard to their phase angle. In addition, the phase position of both cams is variable in relation to the internal combustion engine crankshaft. The charge exchange dynamics of the internal combustion engine may be determined by the so-called variable cam phasing and the variable spread.

DE 4226798 A1 discloses a structural specific embodiment having a single, longitudinally movable positioning bolt which has at least two inclined toothed areas, with the aid of whose shifting movement both the phase position of both cams and their mutual phase angles are changed.

In conventional designs, a sealing cover of this adjusting device is fixedly connected, in particular rotatably fixedly connected, to the outer camshaft or an integral part of the outer camshaft, in an adjusting device, in particular a hydraulically active adjusting device. Pressing elements are usually used for this purpose Due to the fact that the adjusting device frequently has a central screw which is screwed into the inner camshaft and axially fixes a rotor, which acts as the adjuster, relative to the inner camshaft with the aid of an outer shoulder of the central screw, the overall configuration having the inner and outer camshafts is axially fixed with the aid of the adjusting device.

In some specific embodiments of camshaft adjusting devices, however, it is not desirable to have a fixed connection between the sealing cover of the adjusting device and the outer camshaft. However, it is nevertheless still desirable to fix the inner camshaft in a rotatable yet axially determined manner.

It should be noted that a wide range of specific embodiments of phase adjusters exists.

Driving a concentrically situated camshaft with the aid of a vane is less common, since the design is particularly complex.

As mentioned above, the rotor is frequently rotatably fixedly connected to the inner camshaft via a central screw. With the aid of the axial bearing clearance, this rotor determines the axial position of a stator, which is axially shiftably supported on the outer shaft.

SUMMARY OF THE INVENTION

The axial bearing clearance of the outer camshaft is usually determined by abutment surfaces at the bearing points. The axial bearing clearance of the inner shaft, however, is present, limited only by the clearance of an elongated hole connection between the outer shaft and a connecting bolt of the corresponding cam of the inner shaft. This clearance may be several tens of a millimeter, which has an unfavorable effect on the necessary tappet lift of a piston in the central screw and thus on the overall length of the central magnet.

It is an object of the present invention to eliminate the disadvantages from the prior art, in particular to determine the axial position of the inner camshaft and to minimize the necessary installation space.

The present invention provides that the inner camshaft has a locking contour on at least one section of its outside, which engages in a form-fitting manner with a mating contour on at least one section of the inside of the outer camshaft to axially fix the position of the inner camshaft relative to the outer camshaft.

It is thus advantageous if an axial sliding seat is provided between a sealing cover and the outer camshaft.

It is also advantageous if the locking contour, together with the mating contour, is designed in the manner of a bayonet joint connection, preferably without axial clamping. The function of an axial bearing between the inner camshaft and the outer camshaft is particularly efficiently implemented thereby.

To make it easier to insert the inner camshaft into the outer camshaft, it is advantageous if the locking contour is designed as at least one projection which is located on a circumferential section of the inner camshaft, the circumferential section extending over more than 10 degrees but no more than 180 degrees of the circumference of the inner camshaft.

It has proven to be particularly advantageous if the projection is designed as a 180-degree segment. The axial clearance is limited by an additional axial bearing of this type which is implemented by a 180-degree segment of this type, which engages with a corresponding mating contour. The 180-degree segment has an outer diameter which is bigger than the rest of the inner camshaft. The inner camshaft is also understood to be the combination of a tubular element having a sleeve-like end component when it is non-detachably connected thereto or detachable only with difficulty.

If the mating contour is designed as a groove, the insertability is particularly easy to implement, since the inner camshaft having the 180-degree segment is insertable into the outer camshaft in a twisted manner, may then be twisted further, and the corresponding cam may finally be pegged to the inner or outer camshaft. The corresponding segment rotates into the axially limiting groove of the outlet shaft and thus determines the positions of the two shafts in relation to each other.

It is furthermore advantageous if multiple projections are distributed on the outside of the inner camshaft, and multiple grooves or grooves segments parallel to the projections are distributed on the inside of the outer camshaft, permitting an undercut for a form fit. It is, of course, also possible to provide multiple projections but only one groove, which has the corresponding undercut areas for blocking an axial movement of the projections. It is furthermore advantageous if the first and/or second cam(s) is/are designed as inlet cams or as outlet cams. This makes it possible to adjust the corresponding phase position of the desired cam.

Assembly is facilitated if the projection is provided on an originally separate shaft component which is non-detachably connected to the inner camshaft, and/or if the sliding seat is implemented by a sliding toothed area on an originally separate component which is non-detachably connected to the outer camshaft.

The present invention also relates to an internal combustion engine having a camshaft adjusting device designed according to the present invention.

BRIEF DESCRIPTION OF THE DRAWINGS

The present invention is explained in greater detail below with the aid of a drawing. A first exemplary embodiment is illustrated in the figures of the drawing.

DETAILED DESCRIPTION

Figure 1:
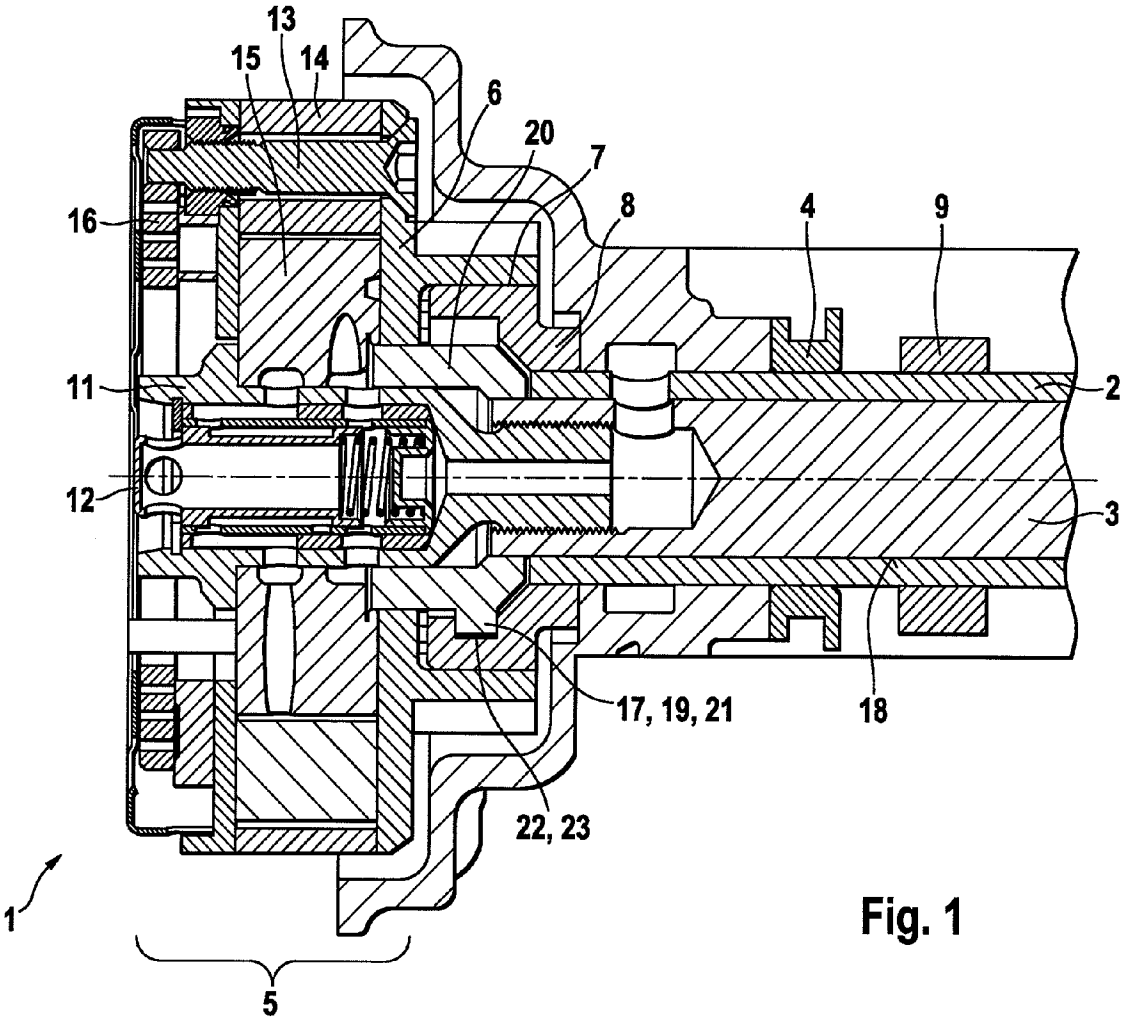
FIG. 1 shows a section of a cross section of a camshaft adjusting device according to the present invention.

The figures are only schematic and are used only for the sake of understanding the present invention. Identical elements are provided with identical reference numerals.

A first specific embodiment of a camshaft adjusting device 1 according to the present invention is illustrated in FIG. 1. A camshaft adjusting device 1 of this type is provided for use in an internal combustion engine. Camshaft adjusting device 1 has two camshafts 2 and 3 which are supported concentrically to each other. The outer camshaft has reference numeral 2 and the inner camshaft has reference numeral 3. The outer camshaft is fixed in its axial position by an axial bearing 4.

An adjusting device 5 for adjusting the angular position between the two camshafts 2 and 3, which has a sealing cover 6, is provided on the left side between the two camshafts 2 and 3. Sealing cover 6 has a sliding toothed area 7 on a section of its inside. Outer camshaft 2 also has a sliding toothed area 7 of this type on a shoulder component 8 which is non-detachably connected to outer camshaft 2. These two sliding toothed areas 7 are in active contact with each other.

A first cam 9 is rotatably fixedly situated on outer camshaft 2. A second cam 10 is not illustrated in FIG. 1 but is nevertheless apparent in FIGS. 2 and 3.

However, a central screw 11 having a piston 12 situated therein is apparent in FIG. 1.

Sealing cover 6 is connected to a stator 14 via a screw connection 13. A rotor, which acts as an adjuster, is provided with reference numeral 15. Screw connection 13 also secures a locking cover 16.

Inner camshaft 3 has a locking contour 17 on at least one section of its outside 18. Locking contour 17 is designed as a 180-degree segment 19. Locking contour 17 is provided on a shaft end component 20 of inner camshaft 3, shaft end component 20 being welded to the rest of inner camshaft 3.

Alternatively, is it possible to implement the projecting section of locking contour 17 on the inside of outer camshaft 2 and to provide a diametrically opposed groove which is open to the outside on the outside of inner camshaft 3.

Engaging with a mating contour 22, which is diametrically opposed to locking contour 17 and is designed as a groove, is 180-degree segment 19, which is also referred to as projection 21. The groove has reference numeral 23.

Figure 2:
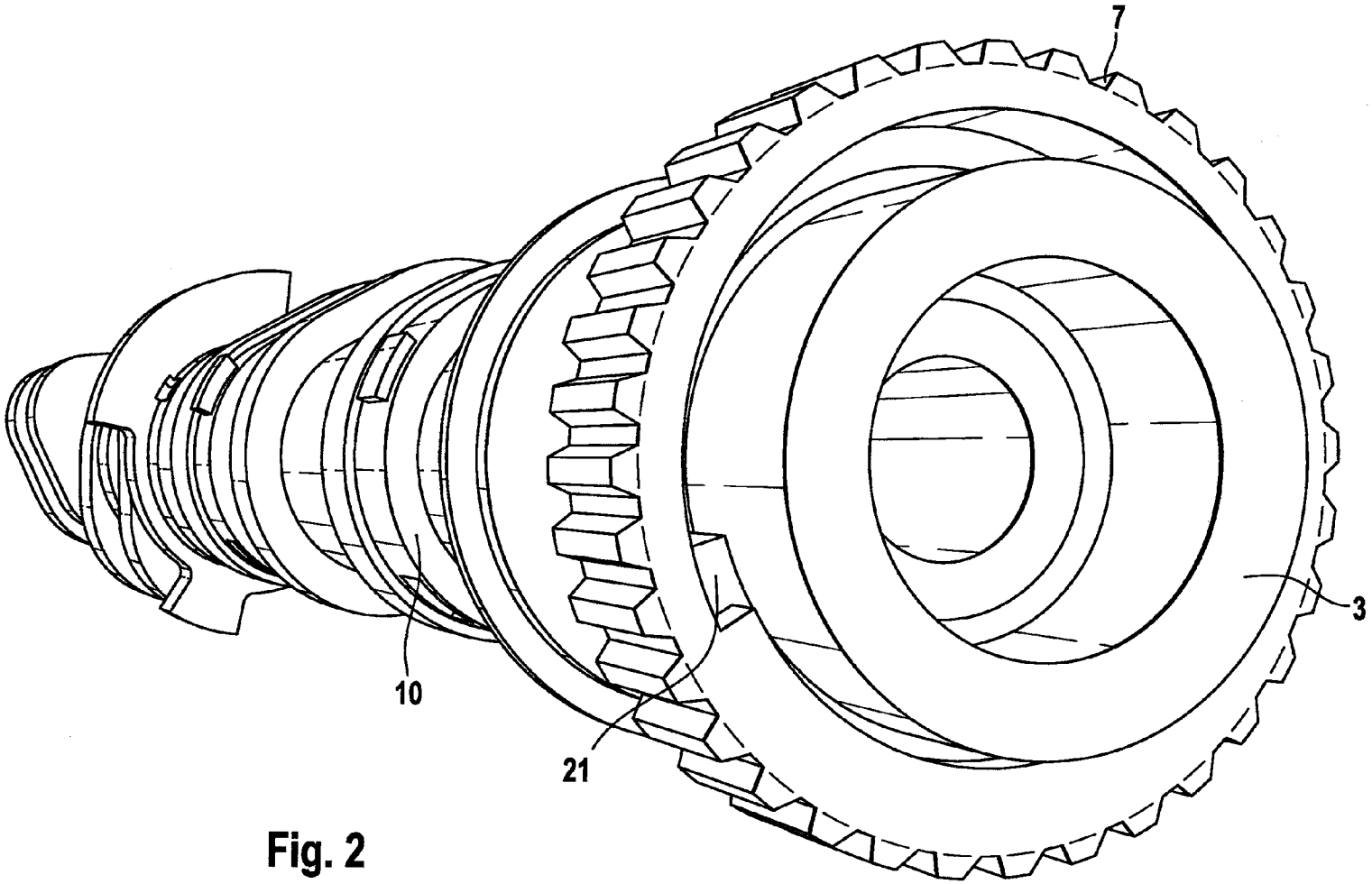
FIG. 2 shows a schematic perspective view of selected elements of the camshaft adjusting device from FIG. 1.
Figure 3:
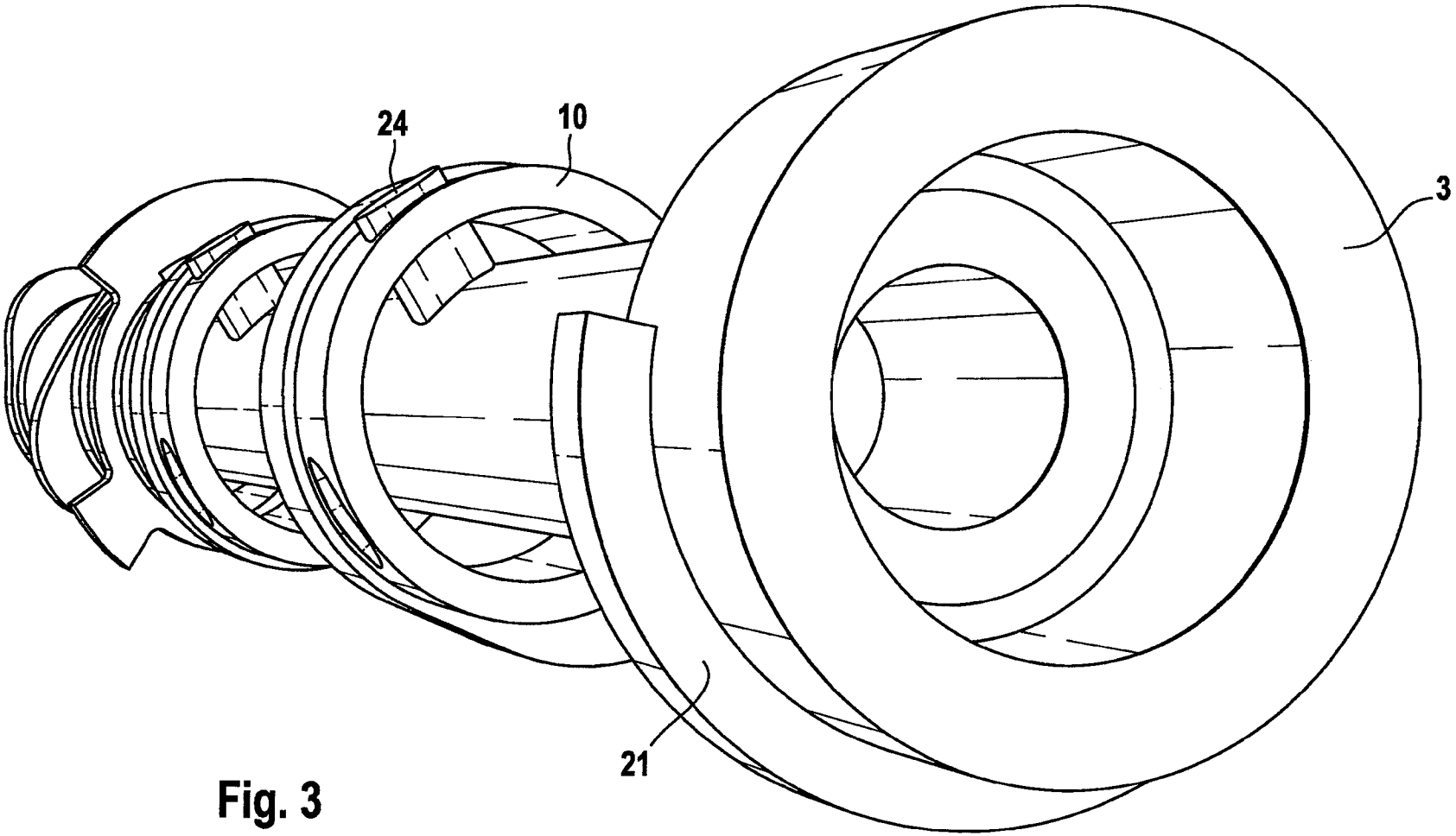
FIG. 3 shows a representation of the camshaft adjusting device from FIG. 2, reduced by a number of components.

Projection 21 is also readily apparent in FIGS. 2 and 3. The connection of second cam 10 via a bolt 24, which engages with an elongated hole (not illustrated) of outer camshaft 2, is also visualized therein.

Figure 4:
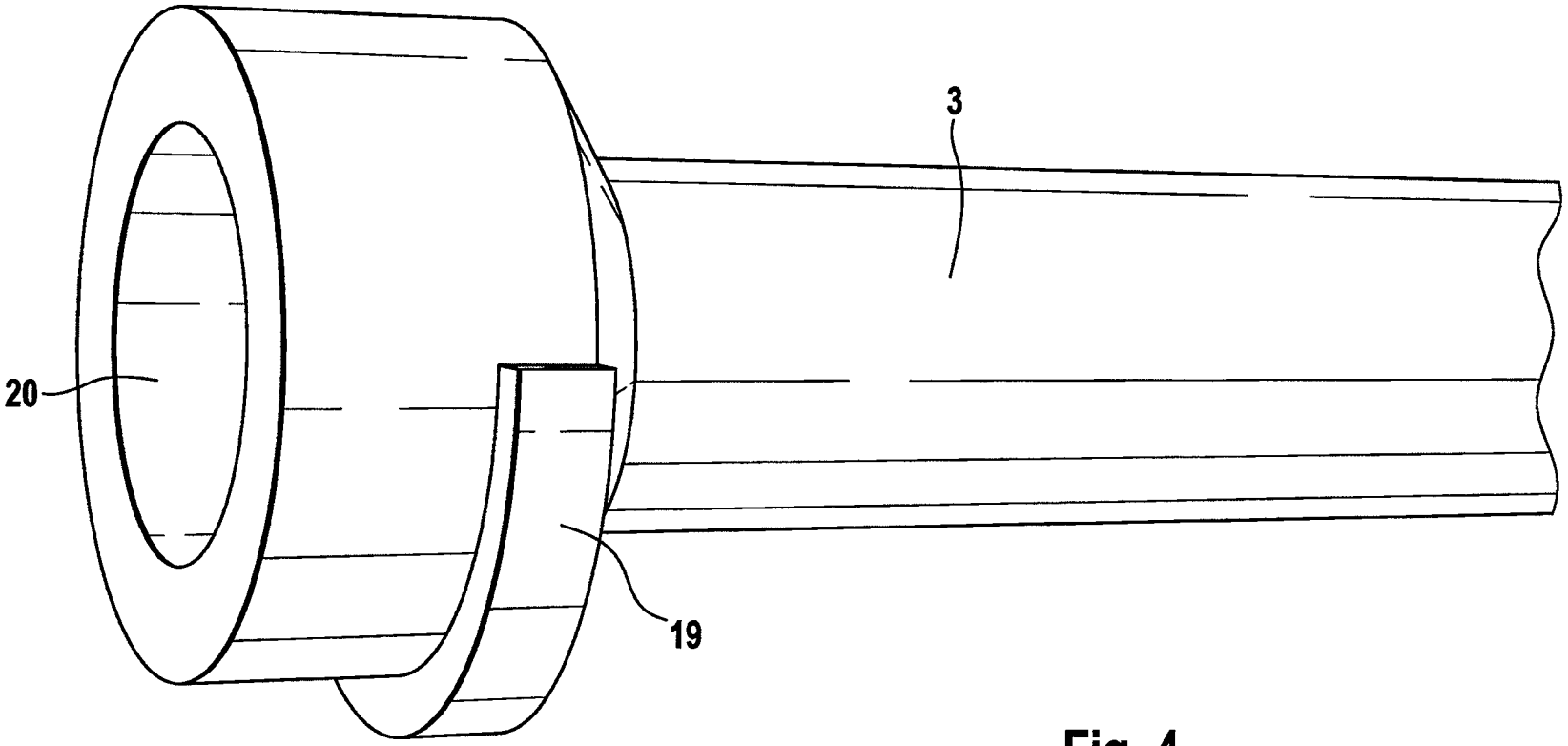
FIG. 4 shows a detailed representation of the locking contour on a section of the outside of the inner camshaft.

FIG. 4, in turn, visualizes the embodiment of projection 21 as a 180-degree segment 19.

LIST OF REFERENCE NUMERALS

1 Camshaft adjusting device
2 Outer camshaft
3 Inner camshaft
4 Axial bearing
5 Adjusting device
6 Sealing cover
7 Sliding toothed area
8 Shoulder component
9 First cam
10 Second cam
11 Central screw
12 Piston
13 Screw connection
14 Stator
15 Rotor/adjuster
16 Locking cover
17 Locking contour
18 Outside
19 180-degree segment
20 Shaft end component
21 Projection
22 Mating contour
23 Groove
24 Bolt

What is claimed is:

1. A camshaft adjusting device of an internal combustion engine having an outer camshaft supported concentrically on an inner camshaft, an axial position of the outer camshaft being determined by an axial bearing, the adjusting device comprising:

a sealing cover having an active relationship with the outer camshaft of an adjusting, a first cam being rotatably fixedly mounted on the outer camshaft, and a second cam being rotatably fixedly connected to the inner camshaft, the inner camshaft furthermore being rotatable relative to the outer camshaft with the aid of the adjusting device, the inner camshaft having a locking contour on at least one section of an outside, the locking contour engaging in a form-fitting manner with a mating contour on at least one section of an inside of the outer camshaft to fix an axial position of the inner camshaft relative to the outer camshaft.

2. The camshaft adjusting device as recited in claim 1 further comprising an axial sliding seat between a sealing cover and the outer camshaft.

3. The camshaft adjusting device as recited in claim 1 wherein the locking contour, together with the mating contour, is designed in the manner of a bayonet joint connection.

4. The camshaft adjusting device as recited in claim 3 wherein the bayonet joint connection is without axial clamping.

5. The camshaft adjusting device as recited in claim 1 wherein the locking contour is designed as at least one projection located on a circumferential section of the inner camshaft, the circumferential section extending over more than 10 degrees but no more than 180 degrees of the circumference of the inner camshaft.

6. The camshaft adjusting device as recited in claim 5 wherein the projection is designed as a 180-degree segment.

7. The camshaft adjusting device as recited in claim 5 wherein the projection is provided on an originally separate shaft end component non-detachably connected to the inner camshaft, or a sliding seat is implemented by a sliding toothed area on an originally separate shoulder component non-detachably connected to the outer camshaft.

8. The camshaft adjusting device as recited in claim 1 wherein the mating contour is designed as a groove.

9. The camshaft adjusting device as recited in claim 1 wherein multiple projections are distributed on an outside of the inner camshaft, and multiple grooves or groove sections matching the projections are distributed on an inside of the outer camshaft to facilitate an undercut for a form fit.

10. The camshaft adjusting device as recited in claim 1 wherein the first or the second cam is designed as an inlet cam or as an outlet cam.

11. An internal combustion engine comprising:

an inner camshaft;

an outer camshaft supported concentrically on the inner camshaft; and the camshaft adjusting device as recited in claim 1.

* * * * *